United States Patent [19]

Kamm et al.

[11] Patent Number: 4,762,096

[45] Date of Patent: Aug. 9, 1988

[54] ENGINE VALVE CONTROL MECHANISM

[75] Inventors: Lawrence J. Kamm, San Diego, Calif.; Lawrence L. Meyer, Northville; Erlen B. Walton, Farmington Hills, both of Mich.

[73] Assignee: Eaton Corporation, Cleveland, Ohio

[21] Appl. No.: 97,235

[22] Filed: Sep. 16, 1987

[51] Int. Cl.[4] ..... F01L 1/34

[52] U.S. Cl. ..... 123/90.16; 123/90.43; 123/90.44; 123/90.17; 123/198 F

[58] Field of Search ..... 123/90.16, 90.17, 90.41, 123/90.43, 90.44, 90.46, 198 F; 74/519, 559

[56] References Cited

U.S. PATENT DOCUMENTS

| | | | |
|---|---|---|---|
| 2,266,077 | 12/1941 | Roan | 123/90.16 |
| 4,151,817 | 5/1979 | Mueller | 123/90.16 |
| 4,203,397 | 5/1980 | Soeters, Jr. | 123/90.16 |
| 4,607,600 | 8/1986 | Yoshizaki | 123/90.16 |
| 4,627,391 | 12/1986 | Derringer | 123/90.16 |
| 4,682,575 | 7/1987 | Simko | 123/90.43 X |
| 4,697,473 | 10/1987 | Patel | 123/90.44 X |

FOREIGN PATENT DOCUMENTS

| | | | |
|---|---|---|---|
| 0168208 | 9/1984 | Japan | 123/90.16 |

*Primary Examiner*—Willis R. Wolfe

*Attorney, Agent, or Firm*—P. S. Rulon

[57] ABSTRACT

An engine valve control mechanism (12) for varying the amount of opening and/or timing of a cylinder valve (16) in a valve gear train (14) of a multi-cylinder, internal combustion engine having an overhead camshaft (24) which actuates the valve via a rocker arm (18) pivotally bridged between a valve stem end (**16*e*) and a hydraulic lash adjuster (31). The valve gear train portion for each intake is provided with a valve control mechanism by providing the camshaft with a high lift lobe (24*c*) and two low lift lobes (24*a*) for actuating the valve and by providing the rocker arm with a rigid link, two low lift cam roller followers (36) fixed to a shaft (40) rotatably mounted on the link, and a high lift cam follower (38) rotatably mounted on the shaft (40) and rotatable between first and second positions for respectively engaging and not engaging the high lift cam lobe (24*c*). A latch member (44) and a solenoid (54) control the position of the high lift cam follower (38**).

19 Claims, 3 Drawing Sheets

FIG 2
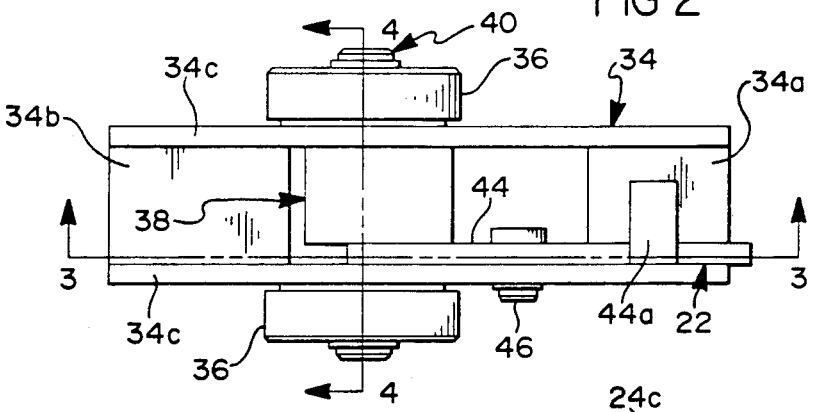
FIG 4
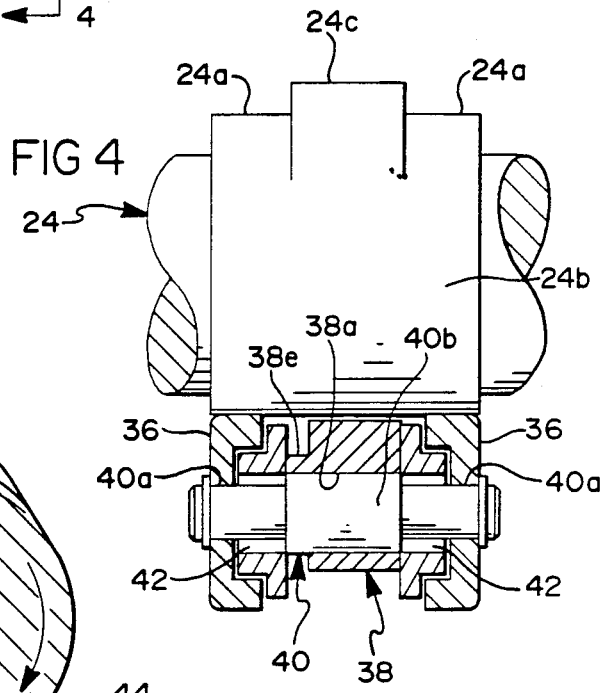
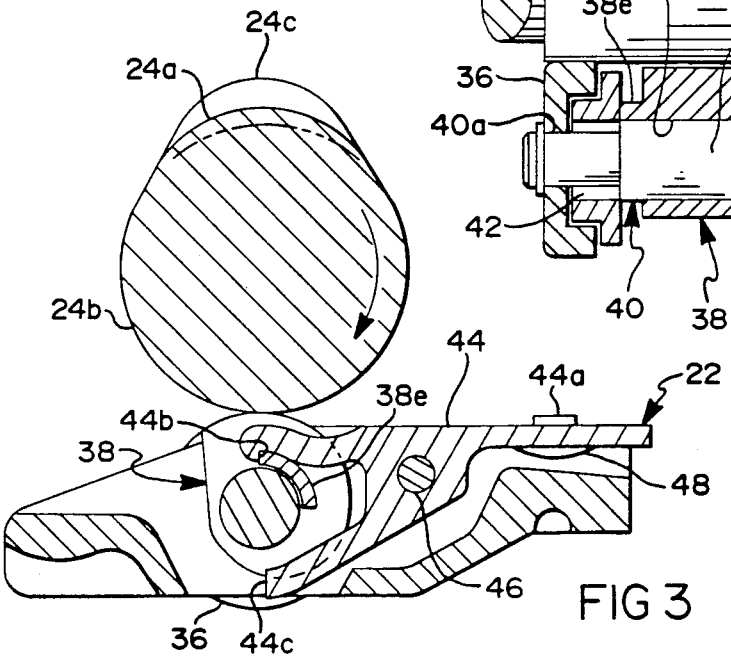
FIG 3

ENGINE VALVE CONTROL MECHANISM

FIELD OF THE INVENTION

This invention relates to an improved mechanism for controlling a valve actuated by a camshaft and more specifically to a mechanism to vary the amount of opening and/or timing of cam actuated valves.

DESCRIPTION OF THE PRIOR ART

It is well known in the internal combustion engine art that a more flexible control of the engine valves will provide improved power and economy at virtually all engine speeds and loads. One method of providing more flexible valve control is taught in U.S. Pat. Nos. 4,151,817 and 4,203,397 which are incorporated herein by reference. Therein the camshafts are provided with high and low lift lobes for actuating each of the engine valves and means selectively operative to shift from valve actuation by one of the lobes to valve actuation by other of the lobes for varying the amount of valve opening and/or valve timing in accordance with engine operating conditions. It is also well known in the internal combustion engine art that improved operating economy may be obtained by disabling the valves of selected cylinders during certain engine operating conditions, for example, when the engine is lightly loaded. Prior U.S. Patent art is replete with patents teaching valve disablement.

The above mentioned patents, like this application, disclose a valve control mechanism including a camshaft having a high lift lobe and two low lift lobes, a rigid link defining a rocker arm with two low lift cam followers cooperating with the two low lift cam lobes and a high lift cam follower selectively movable from a position cooperating and not cooperating with the high lift cam lobe, a latch for controlling the high lift cam follower positions, and solenoid for controlling the latch. In the valve control mechanism of the mentioned patents, the low lift cam followers are in sliding frictional contact with the low lift cam lobes, and the high lift cam follower is pivotally hinged to the rigid link and a spring continuously biased toward the high lift cam lobe. With this prior art arrangement, the high lift cam lobe acts on the high lift cam follower in both latch positions. Accordingly, the high lift cam follower continuously flaps or pivots about the hinge.

The rocker arm of this application reduces friction between the camshaft and rocker arm by use of rollers for the low lift cam followers. Further, the rocker arm of this application is provided with a high lift cam follower which is latched in both the active and inactive positions and is spaced from the high lift cam lobe when in the inactive position.

SUMMARY OF THE INVENTION

An objective of the invention is to provide an improved valve control rocker arm.

According to a feature of the invention, a rocker arm according to the above mentioned prior art includes a rigid link adapted to be pivotally supported at one end and to operate a device at the other end in reponse to rotation of a cam lobe projecting radially outward of a base circle surface of a camshaft effecting pivotal movement of the link by engaging a cam follower operative to transmit displacement of the cam lobe to the link. The cam follower is mounted on the link between the ends and is selectively movable relative to the link between a first position wherein the cam lobe displacement is transmitted to the link and a second position wherein the cam lobe displacement is not transmitted to the link.

The improvement of the prior art comprises roller follower means mounted on the link at a position axially adjacent the cam follower relative to the axis of the camshaft. The roller follower means has an outer cylindrical surface adapted to engage the base circle surface of the camshaft and to maintain a clearance between the cam follower and the base circle surface.

BRIEF DESCRIPTION OF THE DRAWINGS

The valve control mechanism of the present invention is shown in the accompanying drawings in which:

FIG. 2 is an enlarged plan view of the rocker arm looking in the direction of arrow 2 of FIG. 1;

FIG. 3 is a sectional view of the rocker arm looking along line 3—3 of FIG. 2;

FIG. 4 is a sectional view of the rocker arm looking along line 4—4 of FIG. 2;

DETAILED DESCRIPTION OF THE INVENTION

Figure 1:
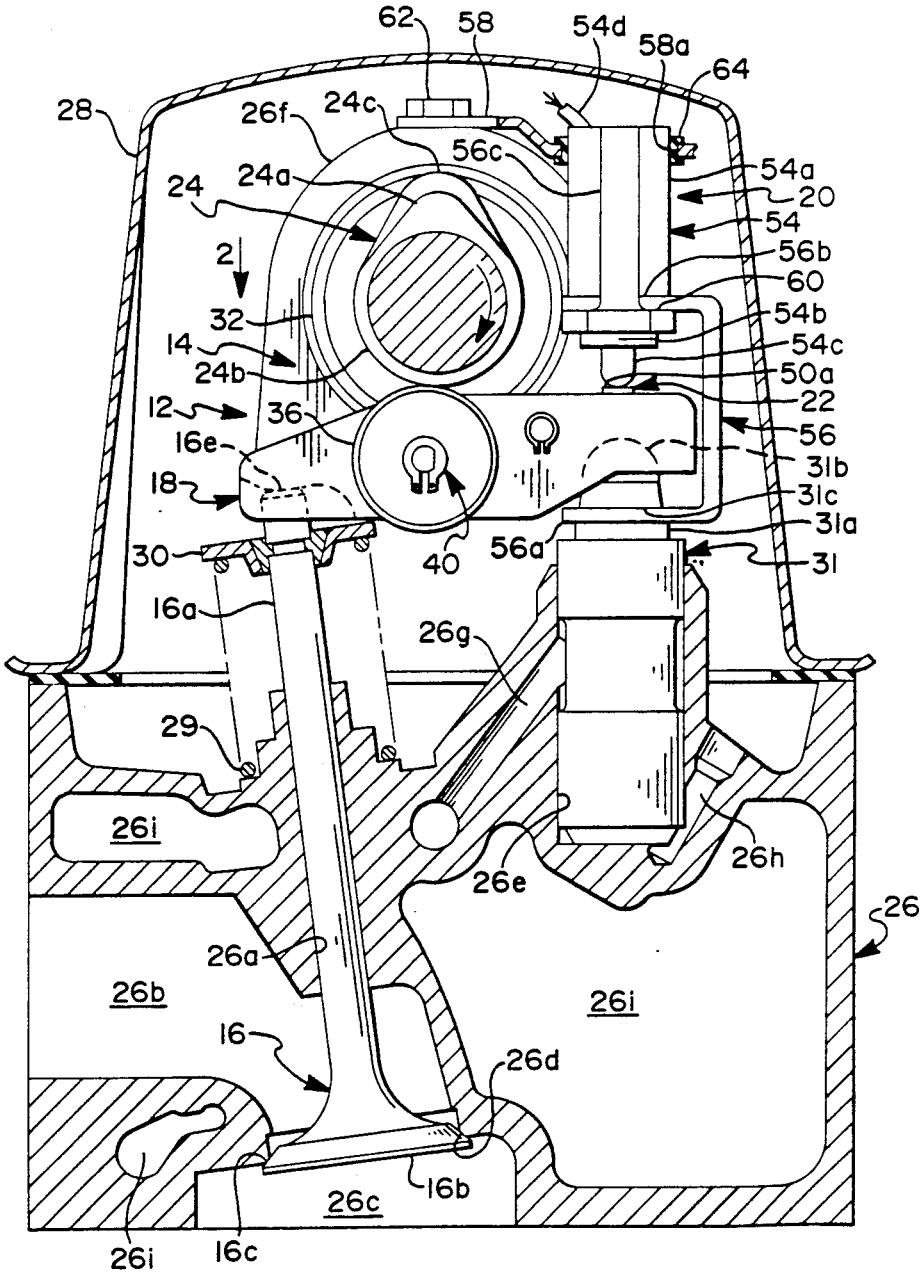
FIG. 1 is a partially sectional view of an internal combustion engine cylinder head embodying a valve control rocker arm and camshaft of the valve control mechanism.

Referring now to FIG. 1, therein is shown in cross-section an internal combustion engine cylinder head assembly of the overhead camshaft type and the inventive valve control mechanism 12 adapted to readily fit into a valve gear train portion 14 for actuating an engine cylinder valve 16 or device to operate. The valve control mechanism includes a rocker arm mechanism 18 which replaces a conventional rocker arm, a solenoid mechanism 20 for positioning a latch mechanism 22 carried by rocker arm mechanism 18, and a camshaft 24 which replaces a conventional camshaft.

The head assembly forms no part of the invention and is shown to merely provide one example of the type of environment in which valve control mechanism 12 may be embodied. The head assembly includes the valve gear train 14, a cast head structure 26, and a sheet metal valve cover 28.

Valve 16 is of the poppet type having a stem portion **16*a* slideably disposed in a guide 26*a* defined by head structure 26 and a valve head portion 16*b*. Valve head portion 16*b* blocks the flow of gases between a passage 26*b* and a recess 26*c* when a conical face 16*c* on the valve head rests on a mating valve seat 26*d* defined or supported by the head structure. Recess 26*c* opens into an unshown combustion chamber which may be cylindrically shaped and have therein a reciprocating piston. Valve 16 is biased on the closed position by a spring 29 which reacts between the head structure and a conventional valve spring retainer 30**.

The valve gear train portion 14 is substantially conventional with the exception of the valve control mechanism. Valve gear train portion 14 includes the valve 16, the rocker arm mechanism 18 pivotally supported at one end by a hydraulic lash adjuster 31 contained in a bore **26*e*** defined by the head structure, and the camshaft 24 journaled in a bearing 32 supported by an arched portion 26*f* defined by the head structure. Lash adjuster 31 includes a piston 31*a* having a hemisperical end (phantom line 31*b*) for pivotally supporting one end of the rocker arm and biasing the rocker arm into zero lash with the camshaft.

The head structure 26 includes, in addition to the above, a passage 26*g* for supplying pressurized oil to the lash adjuster, a passage 26*h* for draining bore 26*e* and assisting in the installation of the adjuster, and three irregularly shaped coolant passages 26*i*.

Referring now to all of the figures and in particular to FIGS. 2–4, camshaft 24 includes a smooth circumferential surface which may be machined or finished by well known methods to define a first surface portion which includes a first pair of low lift cam lobes 24*a* projecting radially outward from a cylindrical surface or dwell portion 24*b* and a second high lift cam lobe 24*c* of substantially conventional height and profile and axially disposed between lobes 24*a*. Cylindrical surface 24*b* is common to lobes 24*a* and lobe 24*c*, concentric to the axis of the camshaft, and defines what is commonly referred to as the base circle of the cam lobes.

High lift cam lobe 24*c* is for effecting a full opening of valve 16 during relatively high engine loading. Low lift cam lobes 24*a* are for effecting a partial opening of valve 16 during relatively low engine loading. Cam lobes 24*a* have identical height and circumferential positions with respect to each other and are completely confined within the circumferential and radial extent of the profile of cam lobe 24*c*. Alternatively, low lift cam lobes 24*a* may be deleted to provide disablement of the valves.

Figure 6:
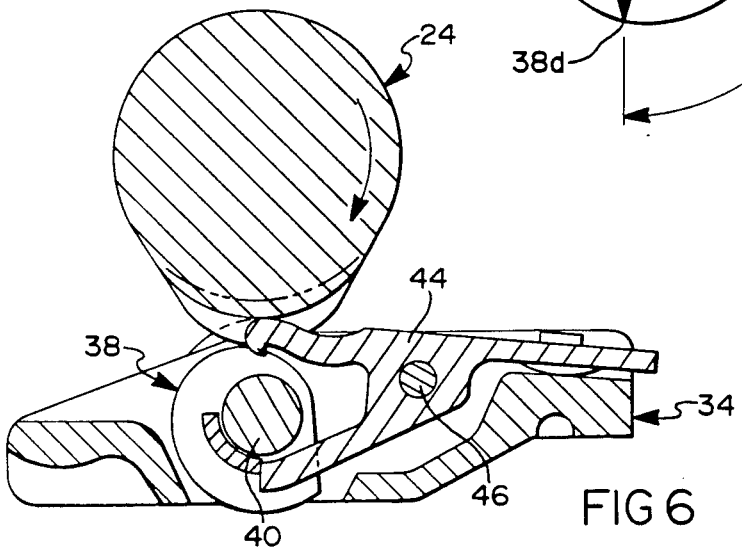

Rocker arm mechanism 18 includes an elongated rigid one piece link 34, two low lift cam follower rollers 36, a high lift cam follower 38, and the latch mechanism 22 which allows selective rotation of follower 38 from a high lift position, as shown in FIG. 3, to a low lift or clearance position, as shown in FIG. 6.

Rigid link 34 is pivotally bridged or supported at its ends by lash adjuster piston 31*a* and valve 16 in a conventional manner. Rigid link 34 includes an end portion 34*a* adapted to pivotally receive the hemispherical end 31*b* of the lash adjuster piston, an end portion 34*b* adapted to drivingly engage an end portion 16*e* of the valve stem, and two rail portions 34*c*.

Low lift cam follower rollers 36 are supported on ends 40*a* of a shaft 40. The shaft is rotatably supported in rails 34*c* via needle bearing 42. The rollers are secured against axial and rotational movement relative to the shaft. Any of several well known methods may be used to secure the rollers to the shaft. When the cam shaft is on base circle, as shown in FIGS. 1, 3, 4, rollers 36 engage the base circle surface 24*b* and rotate shaft 40 in response to camshaft rotation.

Figure 7:
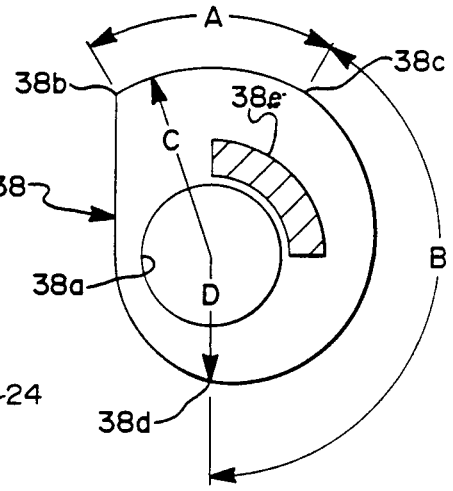
FIG. 7 is an enlarged view of a component of the rocker arm.

High lift cam follower 38, which is shown in enlarged detail in FIG. 7, includes an axially extending through bore 38*a* received by a boss 40*b* of shaft 40, an outer peripheral surface 38*b*, 38*c*, 38*d* extending axially parallel to the axis of shaft 40, and a stop 38*e* extending axially from at least one end face of the follower. The outer peripheral surface includes a curved surface portion of constant radius (circle) and arc length A between points 38*b*, 38*c*, a curved surface portion of constantly decreasing radius (e.g. spiral or involute) and arc length B between points 38*c*, 38*d*, and in irregularly shaped surface between points 38*d*, 38*b*. Alternatively, curved surfaces 38*b*, 38*c* and 38*c*, 38*d* may be a single spiral or curved surface of constantly decreasing radius. The fit between the surface of cam follower bore 38*a* and the surface of shaft base 40*b* is sufficiently close to provide a frictional or viscous drag therebetween for rotating follower 38 between high and low lift positions in response to rotation of rollers 36 by the camshaft. Follower 38 is shown in the high lift position in FIGS. 3, 4, in the low lift position in FIG. 6, and in a transit position in FIG. 5. When in the low lift position, point 38*d* is closely spaced from the high lift cam lobe 24*c*. The rate of decreasing radius of spiral surface 38*c*, 38*d* is preferably the minimum amount needed to have point 38*d* clear the high lift cam lobe when follower 38 is in the low lift position. Accordingly, when the high lift cam follower surface is an arc of a circle, the arc length A is preferably limited to the minimum arc traversed by the high lift cam lobe.

Latch assembly 22 includes a latch member 44 pivotally secured to one of the rigid link rail portions 34*c* by a pin 46 and a bow spring 48 biasing the latch counterclockwise. The latch is selectively pivoted clockwise against the force of spring 48 in response to a downward force applied to a pad 44*a* at the right end of the latch member. The left end of the latch member includes abutments or reaction surfaces 44*b*, 44*c* positionable to engage follower stop 38*e* to selectively latch the follower in the high lift position of FIGS. 3, 4 or low lift position of FIG. 6. Bow spring 48 biases the latch member counterclockwise toward a position effecting engagement of reaction surfaces 44*b* with follower stop 38*e*. The latch member is pivoted clockwise toward a position effecting engagement of reaction surface 44*c* with follower stop 38*e* in response to energization of solenoid mechanism 20.

Solenoid mechanism 20 includes a solenoid 54, a C-shaped bracket 56, and a retaining plate 58. Bracket 56 and plate 58 are shown in partial section. Solenoid 54 includes cylindrical jacket 54*a*, a threaded end 54*b*, a push armature 54*c*, and a pair of conductors 54*d*. Bracket 56 includes a bifurcated end 56*a* which snaps over a groove 31*c* in piston 31*a*, an apertured end 56*b* which receives threaded end 54*b*, and a vertically extending tang 56*c* spaced from the cylindrical wall of jacket 54*a*. A nut 60 firmly fixes the solenoid against movement relative to bracket 56. Retaining plate 58 extends along the length of the head and is fixed to each arched portion 26*f* by bolts 62. Herein only one arch and bolt is shown. Plate 58 includes aperture 58*a* which are each lined with a nylon grommet 64 for slideably receiving the upper portion of cylindrical jacket 54*a* and an unshown slot or notched portion which slideably receives tang 56*c* for preventing rotation of solenoid 54 and bracket 56. Armature 54*c* includes a partially spherical end 54*e* which is slightly spaced from surface of pad 44*a* when the solenoid is in the deenergized position of FIG. 1.

From the foregoing, it should be apparent that a part of the camshaft is always in unyielding contact with the rigid link of the rocker arm regardless of the position of latch mechanism 22. For example, when the valve is inactive or closed, the cylindrical surface or dwell portion 24*b* of the base circle, as shown in FIGS. 3, 4, is in direct contact with the outer cylindrical surfaces of the low lift cam follower rollers 36 independent of the position of high lift cam follower. When latch mechanism 22 is in the high lift position, high lift cam follower surface 38*b*, 38*c* reacts with or engages the high lift cam lobe 24*c*. And when latch mechanism 22 is in the low lift position, the low lift cams 24*a* continue to react with rollers 36 and high lift cam 24*c* clears point 38*d* of follower 38. This unyielding contact between the camshaft and the rigid link of the rocker arm prevents ballooning or over extension of hydraulic lash adjuster 31 or any analogous device for automatically removing lash from the valve gear train and negates the need for resiliently biasing high lift follower toward the camshaft as done in the prior art.

A previously mentioned, friction or viscous drag between shaft bore 40*a* and high lift follower bore 38*e* is intended to effect counterclockwise rotation of follower 38 between its two positions in response to rotation of rollers 36 by camshaft 24 and in response to switching of latch member 44 from one position to the other. However, such rotation of follower 38 does not occur unless base circle 24*b* or low lift cam lobes are in contact with rollers 36. Such contact does not occur when the high lift cam lobe is in contact with the surfaces for high lift follower 36.

When high lift cam follower 38 is in the latched position of FIGS. 3 or 6, rotation of camshaft 24 causes the high or low lift cam lobes to engage their associated cam follower, thereby displacing or pivoting rocker arm 18 counterclockwise about lash adjuster 31 for opening valve 16 against the force of valve spring 29. The force of spring 29 reacts between engaged surfaces of the cam lobe and its associated follower, thereby substantially increasing the forces normal to a plane tangent to the engaged portion of surfaces and also substantially increasing the frictional force therebetween. When high lift cam lobe 24*c* is engaged and valve 16 is open, the frictional forces also reacts between stop 38*e* and abutment surface 44*b* of latch member 44. The frictional forces may be used to prevent unwanted movement of latch member 44 by solenoid 54 when the high lift lobe is engaged and valve 16 is open by limiting the force applied against pad 44*a* to the force incapable of moving the latch.

Figure 5:
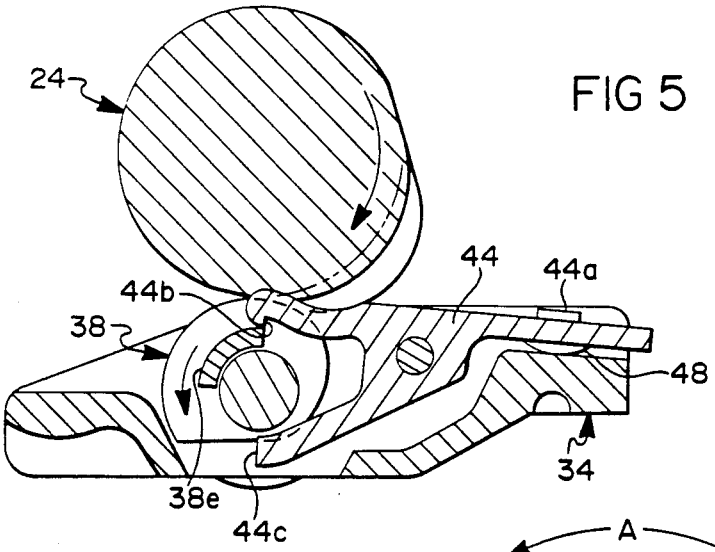
FIGS. 5 and 6 are views of the rocker arm of FIG. 3 with controllable components in different positions.

The forces normal to the plane tangent to the surfaces of the high lift cam follower 38 present no problem when the follower surface is an arc of a circle centered about the axis of shaft 40 since the normal forces act through the axis of the shaft and therefore do not apply a torque to follower 38. Alas, this is not the case when the follower surface is not such an arc of a circle, as must be for all or part of surface 38*c*, 38*d*. Accordingly, if latch member is moved just prior to engagement of high lift cam lobe, as shown in FIG. 5, the normal force acting on the follower surface, not centered about the axis of shaft, can applying a torque greater than the frictional force between the lobe and follower, thereby rapidly rotating the follower relative to the lobe and causing a clashing engagement of the camshaft with roller follower 36. The magnitude of this torque may be kept less than the friction breakaway torque between the high cam lobe surface and the surface between points 38*c*, 38*d* by maintaining the center of radius of surface 38*c*, 38*d* close to the axis of shaft 40. This is done herein by employing a spiral like surface which decreases at a minimum rate necessary to have point 38*d* clear the high lift cam lobe when the follower is in the low lift position.

A preferred embodiment of the invention has been disclosed for illustrative purposes. Many variations and modifications of the preferred embodiment are believed to be within the spirit of the invention. For example, low lift cam lobes 24*a*, which are shown herein centered with respect to high lift cam lobe 24*c*, may be shifted with respect to the high lift lobe to effect earlier or later opening and/or closing of the valves by the low lift lobes. Further, low lift cam lobes 24*a* may be disposed with, whereby valve control mechanism becomes a valve disabler. The following claims are intended to cover the inventive portions of the preferred embodiment and variations and modifications believed to be within the spirit of the invention.

What is claimed is:

1. A rocker arm including a rigid link (34) adapted to be pivotally supported at one end (34*a*) and to operate a device (16) at the other end (34*b*) in response to rotation of a cam lobe (24*c*) projecting radially outward of a base circle surface (24*b*) of a camshaft (24) effecting pivotal movement of the link (34) by engaging a cam follower (38) operative to transmit displacement of the cam lobe (24*c*) to the link (34), the cam follower (38) being mounted (40) on the link between the ends (34*a*, 34*b*) and being selectively movable relative to the link between a first position wherein the cam lobe displacement is transmitted to the link and a second position wherein the cam lobe displacement is not transmitted to the link, the improvement comprising:

roller follower means (36) mounted on the link (34) at a position axially adjacent the cam follower (38) relative to the axis of the camshaft, said roller follower having an outer cylindrical surface adapted to engage the base circle surface (24*b*) of the camshaft (24) and to maintain a clearance between the cam follower (38) and the base circle surface (24*b*).

2. The rocker arm of claim 1, wherein the roller follower (36) is fixed to a shaft (40) rotatably supported by the link (34) and having an axis substantially parallel to the axis of the camshaft (24), the cam follower (38) being mounted on the roller follower shaft (40) for rotation relative to the roller follower shaft and the link (34) and between the first and second positions, said cam follower being operative in the first position to engage the cam lobe (24*c*) and in the second position to not engage the cam lobe (24*c*).

3. The rocker arm of claim 2, wherein the cam lobe (24*c*) is a high lift lobe (24*c*), and the base circle surface (24*b*) of the camshaft (24) includes at least one low lift lobe (24*a*) projecting radially outward of the base circle surface (24*b*) at a position axially adjacent the high lift lobe (24*c*) and radially aligned with the roller follower (36).

4. The rocker arm of claim 2, including means (38*a*, 40*a*) frictionally interconnecting the cam follower (38) and roller follower shaft (40) for effecting rotation of the cam follower (38) between the first and second positions in response to rotation of the roller follower (36).

5. The rocker arm of claim 4, further including latch means (22) selectively movable between at least first and second positions for respectively latching the cam follower (38) in the first and second positions, and wherein movement of the latch means from one position to the other allows rotation of the cam follower (38) to the corresponding position of the latch means.

6. The rocker arm of claim 5, wherein the cam lobe (24*c*) is a high lift lobe (24*c*), and the base circle surface (24*b*) of the camshaft (24) includes at least one low lift lobe (24*a*) projecting radially outward of the base circle surface (24*b*) at a position axially adjacent the high lift lobe (24*c*) and radially aligned with the roller follower (36).

7. The rocker arm of claim 5, wherein the cam follower (38) includes an outer peripheral surface (38*b*, 38*c*, 38*d*) having a first arcuate surface portion (38*b*, 38*c*) spaced a predetermined radial distance from the axis of the roller follower shaft (40) for engaging the cam lobe (24*c*) and a second arcuate surface portion (38*c*, 38*d*) contiguous to the first surface portion (38*b*, 38*c*), the second arcuate surface portion (38*c*, 38*d*) having a radial distance from the roller follower shaft which decreases at a substantially constant rate from the position contiguous to the first surface portion (38*b*, 38*c*).

8. The rocker arm of claim 7, wherein the second surface portion (38*c*, 38*d*) is a spiral surface.

9. The rocker arm of claim 7, wherein the profile of the first surface portion (38*b*, 38*c*) is an arc of circle centered at the axis of the roller follower shaft (40).

10. The rocker arm of claim 7, wherein the first and second surface portions (38*b*, 38*c* and 38*c*, 38*d*) are a continuous spiral surfaces.

11. The rocker arm of claim 1, wherein the link (34) includes two rails (34*c*) axially spaced apart with respect to the axis of the camshaft and interconnecting the link ends (34*a*, 34*b*); the roller follower means including two axially spaced apart roller followers fixed to a roller follower shaft (40) extending through the space between the rails (34*c*) and mounted in the rails for rotation about an axis substantially parallel to the camshaft axis; the cam follower (38) being disposed in the space between the rails (34*c*) and mounted on the roller follower shaft (40) for rotation between the first and second position with said rotation being relative to the roller follower shaft (40) and the link (34), said cam follower (38) being operative in the first portion to engage the cam lobe (24*c*) and in the second position to not engage cam lobe (24*c*).

12. The rocker arm of claim 11, wherein the cam lobe (24*c*) is a high lift lobe (24*c*), and the base circle surface (24*b*) of the camshaft (24) includes first and second low lift lobes (24*a*) projecting radially outward of the base circle surface (24*b*) at a positions axially adjacent opposite sides of the high lift lobe (24*c*) and radially aligned with the roller followers (36).

13. The rocker arm of claim 11, including means (38*a*, 40*a*) frictionally interconnecting the cam follower (38) and roller follower shaft (40) for effecting rotation of the cam follower (38) between the first and second positions in response rotation of the roller followers (36).

14. The rocker arm of claim 11, further including latch means (22) selectively movable between at least first and second positions for respectively latching the cam follower (38) in the first and second positions, and wherein movement of the latch means from one position to the other allows rotation of the cam follower (38) to the corresponding position of the latch means.

15. The rocker arm of claim 14, wherein the cam lobe (24*c*) is a high lift lobe (24*c*), and the base circle surface (24*b*) of the camshaft (24) includes first and second low lift lobes (24*a*) projecting radially outward of the base circle surface (24*b*) at a positions axially adjacent opposite sides of the high lift lobe (24*c*) and radially aligned with the roller follower (36).

16. The rocker arm of claim 14, wherein the cam follower (38) includes an outer peripheral surface (38*b*, 38*c*, 38*d*) having a first arcuate surface portion (38*b*, 38*c*) spaced predetermined radial distance from the axis of the roller follower shaft (40) for engaging the cam lobe (24*c*) and a second arcuate surface portion (38*c*, 38*d*) contiguous to the first surface portion (38*b*, 38*c*), the second arcuate surface portion (38*c*, 38*d*) having a radial distance from the roller follower shaft which decreases at a constant rate from the position contiguous to the first surface portion (38*b*, 38*c*).

17. The rocker arm of claim 16, wherein the second surface portion (38*c*, 38*d*) is a spiral surface.

18. The rocker arm of claim 16, wherein the profile of the first surface portion (38*b*, 38*c*) is an arc of a circle centered at the axis of the roller follower shaft (40).

19. The rocker arm of claim 16, wherein the first and second surface portions (38*b*, 38*c* and 38*c*, 38*d*)are continuous spiral surfaces.

* * * * *